US006261336B1

(12) United States Patent
Behi et al.

(10) Patent No.: US 6,261,336 B1
(45) Date of Patent: Jul. 17, 2001

(54) STABLE AQUEOUS IRON BASED FEEDSTOCK FORMULATION FOR INJECTION MOLDING

(75) Inventors: Mohammad Behi, Lake Hiawatha; Jerry C. LaSalle, Montclair; George A. Glandz, Toms River, all of NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 0 days.

(21) Appl. No.: 09/630,271

(22) Filed: Aug. 1, 2000

(51) Int. Cl.[7] ..... B22F 3/12

(52) U.S. Cl. ..... 75/246; 75/252; 75/254; 75/255; 75/248; 75/249; 419/10; 419/36; 419/40

(58) Field of Search ..... 75/255, 252, 254, 75/246, 248, 249; 419/36, 40, 10; 252/387, 397

(56) References Cited

U.S. PATENT DOCUMENTS

| | | | | |
|---|---|---|---|---|
| 4,098,720 | * | 7/1978 | Hwa | 252/389 |
| 4,915,872 | * | 4/1990 | Ciuba et al. | 252/389 |
| 5,342,578 | * | 8/1994 | Agrawal et al. | 422/13 |
| 5,378,428 | | 1/1995 | Inoue et al. | 422/9 |
| 5,589,106 | * | 12/1996 | Shim et al. | 252/387 |
| 5,746,957 | | 5/1998 | Fanelli et al. | 264/109 |
| 5,906,813 | | 5/1999 | Akao | 424/76.1 |
| 6,013,723 | | 1/2000 | Akao | 524/577 |
| 6,171,360 | * | 1/2001 | Suzuki et al. | 75/255 |

* cited by examiner

*Primary Examiner*—Ngoclan Mai
(74) *Attorney, Agent, or Firm*—Roger H. Criss

(57) ABSTRACT

A composition for forming molded metal containing articles having improved stability. More particularly, a corrosion resistant composition for forming injection molded articles having a sodium silicate corrosion inhibiting additive. The corrosion inhibitor prevents metal oxidation when a metal containing powder is mixed with a water based binder, providing stability to the article and preventing generation of hydrogen gas. This significantly enhances the shelf life of the moldable composition prior to molding.

33 Claims, No Drawings

STABLE AQUEOUS IRON BASED FEEDSTOCK FORMULATION FOR INJECTION MOLDING

BACKGROUND OF THE INVENTION

1. Field of Invention

This invention relates to a composition for forming molded metal containing articles using a molding feedstock having improved stability.

2. Description of the Related Art

Injection molding is a well known process for forming thermoplastic molded articles, such as plastic bottles or containers. Other types of useful injection molded articles are formed from ceramic powder (ceramic injection molding, or "CIM") or metal powder (metal injection molding, or "MIM"), rather than a thermoplastic material. Powder injection molding generally involves injecting a moldable fluid composition, comprising a combination of a ceramic or metal powder, a gel forming binder and a solvent into a mold of a predetermined shape under conditions sufficient to form a shaped article, referred to as a "green body." For example, see U.S. Pat. No. 5,746,957 which teaches a process for forming ceramic and/or metal articles from a composition comprising a ceramic and/or metal powder, a polysaccharide binder and a gel strength enhancing agent. After forming a green body, it is most typically required to sinter the article to densify the article so that it may have useful strength and other physical and mechanical properties.

There are various reasons for which metal or metal containing, ceramic molded articles may be desirable. For example, a metal article may be highly conductive, or a metal component may impart superior strength or durability to an article. Generally, metal injection molded articles may be formed from any pure metal or metal alloy in powder form. Powder injection molding applications typically use wax or polymeric binders, or a water-based binder and solvent for a variety of metals, for example stainless steels or nickel based superalloys. However, it is well known that certain metals and metal compounds oxidize when contacted with water. For example, iron reacts with water to formiron oxide, or rust, and copper reacts with water to form copper oxide. Therefore, it has been a problem in the art to form metal containing compositions using a water based binder while preventing oxidation of the some metals.

To illustrate, U.S. Pat. No. 6,013,723 teaches a composition for injection molding an article incorporating a fatty acid metal salt lubricant. This lubricant is used to inhibit the formation of rust when iron containing compounds are incorporated within the composition. Also, U.S. Pat. No. 5,906,813 teaches a composition for injection molding an article incorporating an antioxidant additive. This antioxidant is used to inhibit the formation of rust when iron containing compounds are incorporated within the composition. Further, U.S. Pat. No. 5,378,428 provides a method of preserving an article wherein the article and an oxygen absorbent composition are sealed inside a container. The oxygen absorbent composition serves to prevent rusting of the article.

SUMMARY OF THE INVENTION

The invention provides a composition for forming molded articles comprising:

a) at least one metal powder or a combination of at least one metal powder and at least one ceramic powder;

b) a gel forming polysaccharide binder; and c) sodium silicate.

The invention also provides a process for forming molded articles comprising:

A) forming a fluid composition comprising:
   i) at least one metal powder or a combination of at least one metal powder and at least one ceramic powder;
   ii) a gel forming polysaccharide binder;
   iii) sodium silicate; and
   iv) a solvent; and B) molding the composition under conditions sufficient to form a solid molded article.

The invention further provides a process for forming molded articles comprising:

A) forming a fluid composition comprising:
   i) at least one metal powder or a combination of at least one metal powder and at least one ceramic powder;
   ii) a gel forming polysaccharide binder;
   iii) sodium silicate; and
   v) a solvent;

B) molding the composition under conditions sufficient to form a solid molded article; and C) sintering the molded article.

The invention still further provides articles produced by the processes of the invention.

It has now been unexpectedly found that adding sodium silicate to a composition comprising a corrosive metal, such as iron or copper, and a water based binder, will suppress oxidization of the metal for a significant time. Moreover, it has been found that adding a borate compound with the sodium silicate will further increase the resistance of the composition to oxidation. Thus a corrosion resistant binder composition is produced for forming injection molded articles through use of a sodium silicate solution and/ or a mixture of sodium silicate solution and potassium tetraborate tetrahydrate as a corrosion inhibiting additive. The corrosion inhibitor prevents metal oxidation when a metal containing powder is mixed with a water based binder, providing stability to the article and preventing generation of hydrogen gas. Specifically, the sodium silicate alone serves as a corrosion inhibitor for about three weeks, while including a borate compound will extend this inhibiting property to a duration of about four months. By preventing oxidation, the corrosion inhibitor also prevents the concurrent generation of hydrogen gas and consumption of moisture essential to the binder composition. This improves the stability of the feedstock molding parameters and thus promotes uniformity in molded articles formed from the feedstock composition.

DETAILED DESCRIPTION OF THE PREFERRED EMBODIMENTS

The present invention provides a process and composition for forming corrosion resistant feedstocks to be used for molding articles wherein the composition comprises at least one metal powder or a combination of at least one metal powder and at least one ceramic powder, a water based gel forming binder and a sodium silicate corrosion inhibitor. Preferably a borate such as potasium tetraborate tetrahydrate is also present as a corrosion inhibitor. This composition is combined with a solvent and molded into a self-supporting shaped article. The article is then preferably heated at a high temperature to sinter the particles thus densifying the material to have useful physical and mechanical properties. The molded article may or may not be corrosion resistant in its final sintered form. The corrosion inhibitor is added to the metal powder to prevent the feedstock from oxidizing. Since the inhibitor is gone after sintering, the final product may oxidize just as any oxidizable metal would. Adding sodium silicate and or mixture of sodium silicate and potasium tetraborate tetrahydrate to the composition allows a water based binder to be employed without causing significant oxidation when the metal powder in the binder is contacted with water present in the aqueous based polysaccharide binder.

To form the moldable composition, the powder element is mixed with the gel forming binder, a solvent such as water, sodium silicate and optionally a borate such as potasium tetraborate tetrahydrate such that a homogeneous composition is formed. This composition is then shredded and either molded through well known techniques or stored for future use. In general, metallic powders suitable for use in molding systems comprise either elemental powders, semi-elemental powders, pre-alloyed powders or mixtures thereof. An elemental powder is generally composed of individual metal element only. For example, an iron or nickel powder or a mixture thereof. A semi-elemental powder is generally a powder composed of more than one metal element, such as a semi-elemental ferrochrome powder comprised of 50% iron and 50% chrome. A mixture of elemental and semi-elemental powders is referred to as an elemental/semi-elemental powder, such as mixing a ferrochrome powder with an iron powder to form stainless steel. A pre-alloyed powder is a powder composition that has been formed from an existing metal alloy. For example, solid high or low carbon steel or super alloys having the desired composition can be melted and pulverized to form a powder. Combining different types of metallic powders may reduce the necessary sintering temperature for an article. This is desirable because higher sintering temperatures can give rise to problems such as the evaporation of lower temperature elements in an alloy.

The preferred metal powders include elemental metal powder compositions such as iron, copper, aluminum, gold, silver, nickel, titanium, tungsten, tantalum, iron, and metal alloy powders such as steels (especially stainless steels), intermetallic compounds, and mixtures thereof. Preferred ceramic powders to be mixed with at least one metal powder non-exclusively include powders of electronics, engineering and structural ceramics such as oxides, borides, nitrides, and silicides, carbides of metals and nonmetals, and mixtures thereof. Examples of such compositions are Ca-modified lead titanate (Ca—PT), Samarium-modified lead titanate, lead metaniobate (PN), modified lead titanates such as $(Pb,Ca)TiO_3$ or $(Pb,Sm)TiO_3$, PZT (lead zirconate titanate, $PbZr_{1-x}Ti_xO_3$), alumina ($Al_2O_3$), zirconia ($ZrO_2$) and silicon carbide (SiC).

Other preferred ceramic compositions to be combined with a metal for the practice of this invention are $K_xNa_{1-x}NbO_3$, where x is between 0 and 0.5, $Na_{1-x}Li_xNbO_3$, where x is 0.02 to 0.13, $Na_{0.75}Pb_{0.125}NbO_3$, $Pb_{0.95}Bi_{0.05}(Ti_{0.975}Zn_{0.025})O_3$, $Pb_{0.95}Bi_{0.033}(Ti_{0.95}Zn_{0.017}Nb_{0.033})O_3$, $Pb_{0.9625}La_{0.025}(Ti_{0.99}Mn_{0.01})O_3$, $Pb(Ti_{0.95}Zn_{0.017}Nb_{0.033})O_3$,$Pb(Ti_{0.606}Zr_{0.394})O_3$, $Pb(Ti_{0.526}Zr_{0.48})O_3$, $Pb_{0.985}Bi_{0.01}(Ti_{0.085}Zr_{0.915})O_3$, $Pb_{0.95}Mg_{0.05}(Ti_{0.54}Zr_{0.43}Cr_{0.03})O_{2.085}$, $Pb_{0.985}La_{0.01}(Ti_{0.085}Zr_{0.915})O_3$, $Pb_{0.988}(Ti_{0.42}Zr_{0.58})Nb_{0.024}O_3$, $Pb_{0.995}(Ti_{0.074}Zr_{0.916}Sb_{0.010})O_3$, and $Na_{0.5}Bi_{0.5}TiO_3$. Certain of the above compositions can be more compactly described by the formula $M_xM'_{1-x}NbO_3$, wherein M and M' are chosen from Na, Li, and K and x is less than one. Other ceramic compositions from this preferred list can be more compactly described by the formula $Pb_xM''_v(Ti_yM_zM'_u)O_3$, wherein M and M' are selected from Zn, Nb, Zr, Sb, and Mn, M" is selected from Bi, La, and Nb, both x+v and y+z+u are about 1, and v is no more than about 0.05.

Relaxor ferroelectric ceramics have the lead titanate type of structure ($PbTiO_3$) and disorder on either the Pb-type of sites (called A sites) or the Ti-type of sites (called B sites). Examples of such relaxor ferroelectrics having B site compositional disorder are $Pb(Mg_{1/3}Nb_{2/3})O_3$(called PMN), $Pb(Zn_{1/3}Nb_{2/3})O_3$ (called PZN), $Pb(Ni_{1/3}Nb_{2/3})O_3$(called PNN), $Pb(Sc_{1/2}Ta_{1/2})O_3$, $Pb(Sc_{1/2}Nb_{1/2})O_3$ (called PSN), $Pb(Fe_{1/2}Nb_{1/2})O_3$(called PFN), and $Pb(Fe_{1/2}Ta_{1/2})O_3$. These are of the form $A(BF_{1/3}BG_{2/3})O_3$ and $A(BF_{1/2}BG_{1/2})O_3$, where BF and BG represent the atom types on the B sites. Further examples of relaxor ferroelectrics with B-site disorder are solid solutions of the above compositions, such as $(1-x)Pb(Mg_{1/3}Nb_{2/3})O_3-xPbTiO_3$ and $(1-x)Pb(Mg_{1/3}Nb_{2/3}),O_3-xPbTiO_3$and $(1-x)Pb(Zn_{1/3}Nb_{2/3})O_3-xPbTiO_3$. Another more complicated relaxor ferroelectric that is preferred for the present invention is $Pb_{1-x}{}^{2+}La_x{}^{3+}(Zr_yTi_z)_{1-x/4}O_3$, which is called PLZT.

The preferred ceramic or metal powders of the composition are selected based on a variety of desired properties and characteristics, such as their size and shape distribution or surface chemistry. If a selected powder having a particular particle size, shape or surface chemistry is not be compatible with the chosen binder, it may be coated with one or more other additives.

The characteristics of the powder chosen is important because the selection can influence and control the flowability, evaporation-condensation, lattice, grain boundary surface diffusion, moldability, shrinkage and sintering mechanisms of the moldable composition. The size distribution of the particles in a powder can also influence the solids loading and moldability of the composition. The shape of the particles is important for flow behavior and shape retention during thermal processing. Preferably the particles are substantially spherical. The powder preferably has an average particle size of from about 1 to about 200 $\mu$m and more preferably from about 4.5 to about 150 $\mu$m. Further, should a combination of ceramic and metal powders, or a selection of different varieties of ceramic or metal powders be used, then they are preferably blended to ensure that each powder is uniformly dispersed within the composition. This allows the additive and binder to perform their functions most effectively and ensures that a maximum solid loading is obtained.

The metal powder, or combination of ceramic and metal powders, is preferably present in the unsintered composition in an amount of from about 50% to about 92% by weight of the composition. More preferably, the powder is present in an amount of from about 75% to about 91% by weight of the composition.

When a combination of a metal powder and a ceramic powder is employed, the weight ratio of metal powder component to ceramic component in the unsintered composition may range from about 1 wt. % to about 99 wt. % metal powder component to about 99 wt. % to about 1 wt. % ceramic component. Preferably, when a combination of a metal powder and a ceramic powder is employed, the weight ratio of metal powder component to ceramic component in the unsintered composition may range from about 60 wt. % to about 85 wt. % metal powder component to about 15 wt. % to about 40 wt. % ceramic component.

The unsintered composition then includes a gel forming binder. The gel forming binder is used primarily to achieve good flowability, good green strength of the molded component, and a high solids loading potential. Suitable binders include water soluble polysaccharide binders. Particularly, the polysaccharide binder preferably comprises an agaroid. For the purposes of this invention, an agaroid refers to agar and any gums resembling agar, and derivatives thereof such as agarose.

An agaroid is employed because it exhibits rapid gelation within a narrow temperature range, a factor which can increase the rate of production of articles. Additionally, the use of such gel-forming binders reduces the amount of binder needed to form a self-supporting article. Therefore, articles produced using gel forming binders comprising agaroids can significantly enhance the quality of and stability of green bodies and sintered articles.

The preferred agaroids are those which are water soluble and comprise agar, agarose, carrageenan, and the like and combinations thereof, and most preferably comprise agar, agarose, and mixtures thereof. The gel forming binder preferably is present in an amount ranging from about 1.5% to about 10% by weight of the composition. More preferably, the binder is present in an amount ranging from about 1.8% to about 5% by weight of the composition.

The unsintered composition then contains a sodium silicate. This sodium silicate is preferably water soluble and is generally commercially available. When added, it stabilizes the moldable composition by delaying oxidation of any corrosive metals present in the composition. It has been found that adding sodium silicate alone will delay the oxidation process in the feedstock material and the unsintered article for about two to about three weeks. The sodium silicate is preferably present in an amount of from about 0.05% to about 2.5% by weight of the composition. More preferably, the sodium silicate is present in an amount of from about 0.1% to about 1.90% by weight of the composition.

It has also been found that adding a borate compound along with sodium silicate will further delay the oxidation process in an unsintered article for a total of about one to about four months. Moreover, an additional benefit to using borate additive is its utility as a gel strength enhancing agent when used in conjunction with a gel-forming binder, such as an agarose. Accordingly, the amount of binder needed to form a self-supporting article is substantially reduced. This property is described in U.S. Pat. No. 5,746,957.

The borate compounds preferred for this invention generally are those which are water soluble and non-exclusively include borate compounds of ammonium, aluminum, barium, bismuth, cadmium, calcium, cerium, cesium, chromium, cobalt, copper, dysprosium, erbium, europium, gadolinium, germanium, iron, lanthanum, lead, lithium, lutetium, magnesium, manganese, mercury, neodymium nickel, potassium, rubidium, silver, strontium, tetraethylammonium, tetramethylammonium, thallium, thorium, titanium, vanadium, ytterbium, yttrium and zinc. Also preferred are hydrates and hydroxides of the compounds as well as mixed cationic species, such as calcium magnesium borate hydrate. These materials are generally commercially available. The most preferred borate compounds are potassium tetraborate and potassium tetraborate tetrahydrate. The borate compound is preferably present in an amount of from about 0.01 to about 0.2% by weight of the composition. More preferably, the borate compound is present in an amount of from about 0.01 to about 0.1% by weight of the composition.

The mixture further comprises a solvent. The solvent is added in an amount sufficient to dissolve the gel forming binder at the melting temperature of the binder. While a wide variety of solvents may be employed depending on the composition of the binder, particularly useful solvents for agaroid binders are polyhedric liquids and polar solvents such as water or alcohols. The most preferred solvent is water.

Each of the metal and ceramic powders described above may have different surface chemistries that may influence the manner in which a composition is prepared. Accordingly, certain powders may need to be coated with a suitable additive prior to combination with other powders having different surface chemistries. Suitable optional additives include coupling agents, antioxidants, lubricants, dispersants, elasticizing agents, plasticizers and compatibilizers. The composition may also optionally contain a wetting agent or surfactant such as polyethylene glycol alkylether, or a lubricant such as zinc stearate, aluminum stearate or magnesium stearate.

The additives are used, in part, to ensure that the binder effectively coats or attaches to the powder particles. Some powder may react or be incompatible with the binder and, therefore, need to be coated with an additive prior to introduction of the binder. Powders may be pretreated with different additives to allow the appropriate additives to perform its function most effectively. These additives are applied by known methods including solvent slurry techniques, wet/dry milling, fluidization techniques, spray drying, dry dispersion or other techniques. The additives designed to interact directly with the powder surface, such as the antioxidants, surfactants, dispersants or coupling agents, are used for the initial coating of the powder. Application sequence of surface-active agents is dependent on powder chemistry and varies according to known chemical properties.

The composition components may be blended in a heated mixer by generally well known techniques. Suitable mixing equipment includes a tumbler with an agglomerate breaker, a ribbon mixer, a vertical screw mixer, a single or twin rotor mixer, and a turbine mixer. Also appropriate for this invention is a screw extruder. Screw extruders are frequently used for fluid processing and comprise a continuous rotating screw or screws in a closely fitting barrel. In practice, materials are fed into the extruder as a dry solids, then are heated and mixed within the barrel to form the fluid composition, and discharged at open end.

Once the composition is mixed, it is preferably shaped into a solid molded article. Various molding processes are well known in the art, including injection molding, hot-rolling, hot-pressing, flat pressing, blow molding, extruding and slip casting. For the fabrication of complex shapes such as cylinders, injection molding and extrusion are especially preferred. In order to help avoid the formation of a porous structure, a vacuum may be applied during the forming step for shaped articles. If a hot-pressing method is used, the stress used for compacting is preferably as high as can be conveniently applied without fracturing the particles. For the purposes of this invention, molding is preferably conducted in an injection molding device. The composition is injected into a mold of a predetermined shape and size while in a fluid state with heat and under conditions sufficient to conform to the shape of the mold. The appropriate mold temperature can be achieved before, during or after the mixture is supplied to the mold. The preferred temperature for melt processing is at least about 5° C. above the gelation point of the binder. More preferably, the temperature for processing is at least about 35° C. above the gelation point of the binder. Molding is preferably conducted at a temperature ranging from about 75° C. to about 95° C. More preferably, the composition is molded at a temperature ranging from about 82° C. to about 95° C.

A wide range of molding pressures may be employed. Generally, the molding pressure is at least about 100 psi, preferably from about 100 psi (689.5 $KN/m^2$) to about 50,000 psi ($3.4\times10^5$ $KN/m^2$) psi, although higher or lower pressures may be employed depending upon the molding technique used. More preferably molding pressures range from about 100 psi to about 2000 psi, and most preferably, are from about 150 psi to about 800 psi. Alternately, the composition may be extruded into pellet or particle form and stored for future molding.

After the article is molded, it is cooled to a temperature below the gel point of the gel-forming material. For the purposes of this invention, this temperature ranges from about 15° C. to about 40° C. More preferably, this temperature ranges from about 30° C. to about 40° C. Following this step, the green body is removed from the mold. The green body may be subsequently dried and placed into a furnace for sintering at high temperatures.

The sintering times and temperatures are regulated according to the powdered material employed to form the fluid composition. In general, the sintering temperatures are selected depending on the individual powders used. Sintering conditions for various materials are easily determinable by those skilled in the art. Ordinarily for wax-based systems, a separate debind step is used which may use toxic solvents. The aqueous based agar binder eliminates that need. This invention extends the applicability of the aqueous binder from stainless steels to plain carbon steels.

For the purposes of this invention, the molded article is preferably sintered at a temperature ranging from about 1000° C. to about 1450° C. More preferably, the article is sintered at a temperature ranging from about 1100° C. to about 1300° C. The resulting product is a substantially dense article.

The following non-limiting examples serve to illustrate the invention. Injection molding pressures quoted refer to machine hydraulic pressure. Solid wt % includes all residual material after removal of volatiles at 150° C.

EXAMPLE 1

Comparative

This example illustrates the problem with the water agar binder system traditionally used for stainless steels when practiced on a non-corrosion resistant iron based material. Carbonyl iron powder (OM powder from BASF) containing about 1% polyethylene was used in preparation of a iron-nickel feedstock. The batch consist of 6500 g carbonyl iron, 130 g (2 wt % based on iron powder), 140 g of agar (binder), 753 g in-situ $DI/H_2O$ (containing calcium borate), 1.6 and 1.2 g of methyl-p-hydroxybenzoate and methyl-p-hydroxybenzoate (biocides) respectively. Agar and biocides were mixed with $DI/H_2O$ and heated to 85–90° C. in a sigma blender. Iron and nickel powders were pre-mixed and added to the melted binder. The material was mixed for 30–45 min. at 85–90° C. The material cooled to 30–35° C. and shredded. The moisture content was adjusted to 90.75 and 92 wt %. Because of the presence of iron powder in aqueous medium and potential reactivity of the powder the material was monitored for 24 hours for any visual changes. The temperature of the material after 24 hours was higher than room temperature (25–30° C.). This indicated that the material is slowly reacting with $H_2O$ and slowly generating $H_2$ gas. The moldability of the material at 92 wt % was good but material discarded because of its reactivity with $H_2O$.

EXAMPLE 2

Comparative

This example illustrates that a commercially available iron powder passivated by silica is ineffective in preventing reactivity of iron with water present in the binder. This batch was prepared with carbonyl iron (OS powder from BASF) containing about 1 wt % silica as an additive to prevent the reaction of the powder with aqueous binder. The batch formulation and mixing procedure was same as example 1. The silica additive was not effective and results were same as Example 1. Hydrogen evolution takes place after 24 hours. A similar result was observed as for Example 1.

EXAMPLE 3

Comparative

This example illustrates that powder coating techniques are not protective in preventing corrosion of iron powder with the water present in the binder. In this example 2 wt % nickel was added to carbonyl iron (OM powder with no polyethylene additive) by an electroless plating process to form a protective coating and prevent the reaction of the iron powder in the aqueous medium. One hundred grams of carbonyl iron powder were coated with 2 wt % nickel using ammonia, sodium tetrahydridoborate bath. The powder was washed by acetone and etched by HCl (1:10) prior to coating. The coating time was 15 min. followed by rinsing with acetone and drying. A sample was prepared using 50 g of this powder (containing 2 wt % nickel as a coating) mixed with 14 g $DI/H_2O$ and 1.5 g agar. The mixture was heated in a hot water bath at 100° C. and stirred until the binder was melted and uniformly incorporated with the powder. The feedstock sample cooled to room temperature and shredded. The moisture content was adjusted to 8 wt %. A sample of this feedstock was tested fresh and after 24 hours for $H_2$ evolution. The material was not stable and generated $H_2$ after 24 hours. This is indicates that the coating did not effectively protected the iron powder from oxidation. The nickel coating thickness was about 0.013 micron and did not provide a dense layer on iron particles.

EXAMPLE 4

This example shows that the addition of sodium silicate to the water present in the binder is an effective retardant of iron reactivity with water. A feedstock sample was made using 80 g of carbonyl iron containing 2 wt % nickel powder, 20 g of $DI/H_2O$, 2.4 g of agar, 1.2 g sodium silicate solution (from Aldrich) and 0.9 and 0.7 wt % (based on agar amount) of methyl and propyl-p-hydroxybenzoate respectively. The powder was added to a mixture of agar, biocides and water/sodium silicate mixture. The mixture was heated in a hot water bath at 100° C. and stirred until the binder was melted and uniformly incorporated with the powder. The feedstock sample cooled to room temperature and shredded. The moisture content was adjusted to 8 wt %. A sample of this feedstock was tested fresh and after 24 hours for H2 evolution. The result indicated that no $H_2$ gas was generated after 24 hours. The sample was tested periodically every three to four days. For about three weeks the sample remain stable and no $H_2$ was detected. The feedstock formulation with sodium silicate additive effectively protected the iron powder in the aqueous binder medium and prevents $H_2$ evolution for about three weeks.

EXAMPLE 5

This example shows that the addition of sodium silicate and potassium tetraborate tetrahydrate to the water present in the binder is an effective retardant of iron reactivity with water The feedstock formulation for this example comprises 80 g of carbonyl iron containing 2 wt % nickel powder. The other constituents for this formulation are 20 g of DI/$H_2O$, 2.4 g of agar, 1.2 g sodium silicate solution (from Aldrich), 0.024 g of potassium tetraborate tetrahydrate (from Aldrich) and, 0.9 and 0.7 wt % (based on agar amount) of methyl and propyl-p-hydroxybenzoate respectively. Potassium tetraborate tetrahydrate and sodium silicate was mixed with DI/$H_2O$. Agar, biocides and metal powder was added to the mixture. The mixture was heated in a hot water bath at 100° C. and stirred occasionally until the binder was melted and uniformly incorporated with the powder. The feedstock sample cooled to room temperature and shredded. The moisture content was adjusted to 8 wt %. A sample of this formulation was tested for $H_2$ evolution weekly. The testing was continued for more than four months and showed no $H_2$ evolution. This formulation shows that the combination of potassium tetraborate and sodium silicate provide a synergistic effects for material stability and prevents $H_2$ evolution for more than four months.

EXAMPLE 6

A similar formulation as in Example 5 was prepared for compounding a 32 kg batch using a twin-screw compounding machine. The DI/$H_2O$ was pre-mixed with 0.27 wt % potassium tetraborate and about 12 wt % of sodium silicate solution. The carbonyl iron powder containing 2 wt % nickel powder was compounded with about 2.1 wt % agar and biocides and 8 wt % of pre-mixed DI/$H_2O$. The material was tested for $H_2$ evolution. The material was stabile with no $H_2$ evolution for more than four months. Several tensile bar samples were molded at 92 wt % solids. The material was fed into an injection molding machine and molded with no apparent problems.

EXAMPLE 7

This example shows that the addition of sodium silicate and potassium tetraborate tetrahydrate to the water present in the binder is an effective retardant of iron reactivity with water Lower amounts of additives were used in preparation of this batch. The DI/$H_2O$ was pre-mixed with 0.15 wt % potassium tetraborate and about 6 wt % of sodium silicate solution. The carbonyl iron powder containing 2 wt % nickel powder was compounded with about 2.1 wt % agar and biocides and 8 wt % of pre-mixed DI/$H_2O$. The material was tested for $H_2$ evolution. The material shows no $H_2$ evolution for more than four months. The material was fed into an injection molding machine and molded with no apparent problems.

The foregoing examples show that the feedstock materials with no additives are not stable. The carbonyl iron powder slowly reacts with the aqueous binder medium and generates $H_2$ gas. The sodium silicate additive provides material stability of three weeks. A mixture of sodium silicate and potassium tetraborate additives provides excellent prevention of hydrogen evolution for at least four months.

While the present invention has been particularly shown and described with reference to preferred embodiments, it will be readily appreciated by those of ordinary skill in the art that various changes and modifications may be made without departing from the spirit and scope of the invention. It is intended that the claims be to interpreted to cover the disclosed embodiment, those alternatives which have been discussed above and all equivalents thereto.

What is claimed is:

1. A corrosion resistant composition for forming molded articles comprising:

a) at least one metal powder or a combination of at least one metal powder and at least one ceramic powder;

b) a gel forming polysaccharide binder; and c) sodium silicate.

2. The composition of claim 1 further comprising a borate additive.

3. The composition of claim 2 wherein the borate additive comprises a water soluble compound selected from the group consisting of borate compounds of ammonium, aluminum, barium, bismuth, cadmium, calcium, cerium, cesium, chromium, cobalt, copper, dysprosium, erbium, europium, gadolinium, germanium, iron, lanthanum, lead, lithium, lutetium, magnesium, manganese, mercury, neodymium nickel, potassium, rubidium, silver, strontium, tetraethylammonium, tetramethylammonium, thallium, thorium, titanium, vanadium, ytterbium, yttrium, zinc and hydrates and hydroxides thereof.

4. The composition of claim 2 wherein the borate additive comprises potassium tetraborate or potassium tetraborate tetrahydrate.

5. The composition of claim 1 further comprising a solvent.

6. The composition of claim 5 wherein the solvent comprises water.

7. The composition of claim 1 wherein the at least one ceramic powder is selected from the group consisting of oxides, borides, nitrides, silicides, and carbides of metals and nonmetals, and mixtures thereof.

8. The composition of claim 1 wherein the at least one metal powder is selected from the group consisting of iron, copper, aluminum, gold, silver, nickel, titanium, tungsten, tantalum, iron, metal alloys, intermetallic compounds and mixtures thereof.

9. The composition of claim 1 wherein the binder comprises agar.

10. The composition of claim 1 wherein the powder is present in an amount ranging from about 50% to about 92% by weight of the composition.

11. The composition of claim 1 wherein the gel forming binder is present in an amount ranging from about 1.5% to about 10% by weight of the composition.

12. The composition of claim 1 wherein the sodium silicate is present in an amount ranging from about 0.05 to about 2.5% by weight of the composition.

13. The composition of claim 2 wherein the borate compound is present in an amount ranging from about 0.01 to about 0.2% by weight of the composition.

14. A process for forming molded articles comprising:

A) forming a fluid composition comprising:

i) at least one metal powder or a combination of at least one metal powder and at least one ceramic powder;

ii) a gel forming polysaccharide binder;

iii) sodium silicate; and v) a solvent;

B) molding the composition under conditions sufficient to form a solid molded article; and C) sintering the molded article.

15. The process of claim 14 wherein the composition further comprises a borate additive.

16. The process of claim 15 wherein the borate additive comprises a water soluble compound selected from the group consisting of borate compounds of ammonium, aluminum, barium, bismuth, cadmium, calcium, cerium, cesium, chromium, cobalt, copper, dysprosium, erbium, europium, gadolinium, germanium, iron, lanthanum, lead, lithium, lutetium, magnesium, manganese, mercury, neodymium nickel, potassium, rubidium, silver, strontium, tetraethylammonium, tetramethylammonium, thallium, thorium, titanium, vanadium, ytterbium, yttrium, zinc and hydrates and hydroxides thereof.

17. The process of claim 15 wherein the borate additive comprises potassium tetraborate or potassium tetraborate tetrahydrate.

18. The process of claim 14 wherein the composition is molded at a temperature ranging from about 75° C. to about 95° C.

19. The process of claim 14 wherein the molding is conducted in an injection molding device.

20. The process of claim 14 wherein the molded article is sintered at a temperature ranging from about 1000° C. to about 1450° C.

21. The process of claim 14 wherein the at least one ceramic powder is selected from the group consisting of oxides, borides, nitrides, silicides, and carbides of metals and nonmetals, and mixtures thereof.

22. The process of claim 14 wherein the at least one metal powder is selected from the group consisting of iron, copper, aluminum, gold, silver, nickel, titanium, tungsten, tantalum iron, metal alloys, intermetallic compounds and mixtures thereof.

23. The process of claim 14 wherein the binder comprises agar.

24. The process of claim 14 wherein the solvent comprises water.

25. The process of claim 14 wherein the powder is present in the composition in an amount ranging from about 50% to about 95% by weight of the composition.

26. The process of claim 14 wherein the gel forming binder is present in an amount ranging from about 1.5% to about 10% by weight of the composition.

27. The process of claim 14 wherein the sodium silicate is present in an amount ranging from about 0.05 to about 2.5% by weight of the composition.

28. The process of claim 15 wherein the borate compound is present in an amount ranging from about 0.01 to about 0.2% by weight of the composition.

29. An article produced by the process of claim 14.

30. An article produced by the process of claim 15.

31. A process for forming molded articles comprising:

A) forming a fluid composition comprising:

i) at least one metal powder or a combination of at least one metal powder and at least one ceramic powder;

ii) a gel forming polysaccharide binder;

iii) sodium silicate; and iv) a solvent; and

B) molding the composition under conditions sufficient to form a solid molded article.

32. The process of claim 31 wherein the composition further comprises potassium tetraborate or potassium tetraborate tetrahydrate.

33. An article produced by the process of claim 31.

* * * * *